US006176685B1

(12) United States Patent
Iizuka et al.

(10) Patent No.: US 6,176,685 B1
(45) Date of Patent: Jan. 23, 2001

(54) SCROLL COMPRESSOR IN WHICH COMMUNICATION IS CONTROLLED BETWEEN ADJACENT COMPRESSION SPACES

(75) Inventors: Jiro Iizuka, Takasaki; Akiyoshi Higashiyama, Gunma, both of (JP)

(73) Assignee: Sanden Corporation, Gunma (JP)

( * ) Notice: Under 35 U.S.C. 154(b), the term of this patent shall be extended for 0 days.

(21) Appl. No.: 09/236,550

(22) Filed: Jan. 26, 1999

(30) Foreign Application Priority Data

Jan. 28, 1998 (JP) ..... 10-016026

(51) Int. Cl.[7] ..... F04B 49/00

(52) U.S. Cl. ..... 417/310; 417/299; 417/440; 417/295; 417/308; 418/55.1; 418/55.4; 418/55.5; 62/505

(58) Field of Search ..... 417/299, 310, 417/440, 295, 308; 418/55.5, 55.4, 15, 55.1; 62/505

(56) References Cited

U.S. PATENT DOCUMENTS

| | | | | |
|---|---|---|---|---|
| Re. 34,148 | | 12/1992 | Terauchi et al. | 417/310 |
| 4,505,651 | * | 3/1985 | Terauchi et al. | 417/440 |
| 4,642,034 | | 2/1987 | Terauchi | 417/295 |
| 4,673,340 | | 6/1987 | Mabe et al. | 418/15 |
| 4,744,733 | | 5/1988 | Terauchi et al. | 417/310 |
| 4,904,164 | | 2/1990 | Mabe et al. | 417/308 |
| 4,940,395 | | 7/1990 | Yamamoto et al. | 417/310 |
| 5,240,388 | | 8/1993 | Matsumoto et al. | 417/299 |
| 5,253,489 | | 10/1993 | Yoshii | 627/505 |
| 5,269,661 | | 12/1993 | Iizuka et al. | 417/310 |
| 5,336,058 | * | 8/1994 | Yokoyama | 417/299 |
| 5,362,211 | | 11/1994 | Iizuka et al. | 417/310 |
| 5,503,542 | * | 4/1996 | Grassbaugh et al. | 418/55.1 |
| 5,562,426 | * | 10/1996 | Watanabe et al. | 417/310 |
| 5,639,225 | * | 6/1997 | Matsuda et al. | 417/299 |
| 5,674,058 | * | 10/1997 | Matsuda et al. | 417/440 |
| 5,860,791 | * | 1/1999 | Kikuchi | 417/310 |

FOREIGN PATENT DOCUMENTS

| | | |
|---|---|---|
| 3626796 | 3/1987 | (DE) . |
| 0557023 | 8/1993 | (EP) . |
| 59-108896 | 6/1984 | (JP) . |
| 60-162093 | 8/1985 | (JP) . |
| 3225093 | 10/1991 | (JP) . |
| 7-324690 | 12/1995 | (JP) . |

OTHER PUBLICATIONS

Patent Abstracts of Japan, Publication No. 57217395, Publication Date Jun. 19, 1984, (Application No. 7217395, filed Dec. 19, 1992).

Patent Abstracts of Japan, Publication No. 62291491, Publication Date Dec. 18, 1987, (Application No. 61135052, filed Jun. 12, 1986).

* cited by examiner

*Primary Examiner*—Timothy S. Thorpe
*Assistant Examiner*—Steven Brown
(74) *Attorney, Agent, or Firm*—Baker Botts L.L.P.

(57) ABSTRACT

In a scroll compressor provided with a fixed scroll member (4) and a movable scroll member (3) which define a plurality of compression spaces (6) therebetween in cooperation with each other, a hole (32) is formed to the fixed scroll member to be communicable with adjacent ones of the compression spaces. The adjacent compression spaces are different from each other in pressure when the scroll compressor is driven. A piston valve (33) is disposed in the hole and controls communication between the adjacent compression space through the hole. The compression spaces are movable with volumes reduced by movement of the movable scroll member.

15 Claims, 10 Drawing Sheets

SCROLL COMPRESSOR IN WHICH COMMUNICATION IS CONTROLLED BETWEEN ADJACENT COMPRESSION SPACES

BACKGROUND OF THE INVENTION

The present invention relates in general to a scroll compressor and more particularly to a chock reduction mechanism for reducing a shock at the time of starting of the compressor.

A scroll compressor having a shock reduction mechanism has been used for air conditioners in automotive vehicles. In general, the air conditioner for automobiles is driven by an engine of the automobiles by way of an electromagnetic clutch and a belt so that driving and stop of the air conditioner is selected by an on-off operation of the electromagnetic clutch. Therefore, shocks are added to a body of the automobile due to a load variation at the starting time of the air conditioner and, consequently, a riding comfort is spoiled. Thus, an attempt has been sought to restrict or lessen the load variation at the starting time and to lessen a shock received by the body of the automobile.

An attempt is made to overcome the shortcomings described above by providing a new mechanism for a scroll compressor, as disclosed in JP-A-7-324690 in which the scroll compressor has, on an end plate of a fixed scroll member, a cylinder extending in a radial direction and a bypass channel which connects the cylinder with an operation chamber or a compression space. The cylinder is provided with a spool valve to displace the spool valve within the cylinder by the use of a pressure difference, so that a refrigerant gas which is in the midst of compression at the starting time is returned to a suction chamber through the bypass channel and the cylinder. This permits reduction of volume of the compressor at the starting time and, therefore, the load difference at the starting time can be reduced.

However, the scroll compressor suggested by JP-A-7-324690 involves some problems that a compression load is generated by a compression loss because of utilization of the by-pass channel provided for the purpose of returning the refrigerant gas into the suction chamber and, therefore, a reduction effect of a shock to the vehicle body is limited to a low level. Further, in order to reduce a pressure loss at the by-pass chamber, the size of the spool valve and the cylinder must be designed to be large enough and, accordingly, this results in a large-size fixed scroll member and finally a large scaled entire structure of the scroll compressor. Besides the above, when the discharge pressure which provides a pressure difference for driving the spool valve results in a pressure variation as pulsation or the like, it is likely that the spool valve is driven out of the predetermination. Consequently, there are cases that the reduction effect of shock to the vehicle body is lowered.

SUMMARY OF THE INVENTION

It is therefore an object of the present invention to provide a scroll compressor which permits to reduce a load variation at the starting time of the compressor without involvement of problems of a pressure loss and larger/heavy structure.

It is another object of the present invention to provide a scroll compressor of the type described, in which communication is controlled between adjacent compression spaces so as to enable variable displacement in the scroll compressor.

Other objects of the present invention will become clear as the description proceeds.

A scroll compressor to which the present invention is applied comprises a fixed scroll member and a movable scroll member which define a plurality of compression spaces therebetween in cooperation with each other. The compression spaces are movable with volumes reduced by movement of the movable scroll member. The scroll compressor further comprises a hole defining surface formed to the fixed scroll member for defining a hole communicable with adjacent ones of the compression spaces. The adjacent ones are different from each other in pressure when the scroll compressor is driven. The scroll compressor further comprises a valve member disposed in the hole for controlling communication between the adjacent ones through the hole.

According to an aspect of the present invention, there is provided a scroll compressor which comprises a fixed scroll member having an end plate, a movable scroll member eccentrically spaced from the fixed scroll member and having an end plate, a compression space formed between the fixed scroll member and the movable scroll member, the compression space being movable with its volume reduced by an orbiting movement of the movable scroll member, a cylinder channel provided on the end plate of the fixed scroll member and capable of being connected with the compression space, and a piston valve disposed in the cylinder channel such that the piston valve is movable between a first position contacted with an upper surface of an involute portion of the movable scroll member and a second position spaced from the first position, a fluid in the compression space being permitted to flow into a low pressure space between the movable scroll member and the fixed scroll member through the cylinder channel when the piston valve is position in the second position.

According to another aspect of the present invention, there is provided a scroll compressor which comprises a fixed scroll member having an end plate, a movable scroll member eccentrically spaced from the fixed scroll member and having an end plate, a compression space formed between the fixed scroll member and the movable scroll member, the compression space being movable with its volume reduced by an orbiting movement of the movable scroll member, at least a single two-step shaped hole provided on the end plate of the fixed scroll member such that the two-step shaped hole is opened at one side thereof to the compression space, with a sectional area of the opened portion being smaller than a sectional area of the other portion, a two-step shaped piston valve slidably contacted with each step of the two-step shaped hole, a first sealed space formed between a large diameter portion and a step portion of the two-step shaped hole, a biasing means, disposed in the first sealed space and contacted with the large diameter portion of the piston valve and the step portion of the two-step shaped hole of the fixed scroll member, for biasing the piston valve in the clearance-increasing direction between an upper end surface of an involute portion of the movable scroll member and an end surface of a small diameter portion of the piston valve, a suction pressure inlet, disposed on the end plate of the fixed scroll member, for connecting the first sealed space with the suction chamber, a second sealed space formed in a confronting relation with the first sealed space with the large diameter portion of the piston valve being disposed therebetween, and a discharge pressure inlet connecting the second sealed space with a discharge port of the fixed scroll member.

DESCRIPTION OF THE PREFERRED EMBODIMENTS

Figure 1:
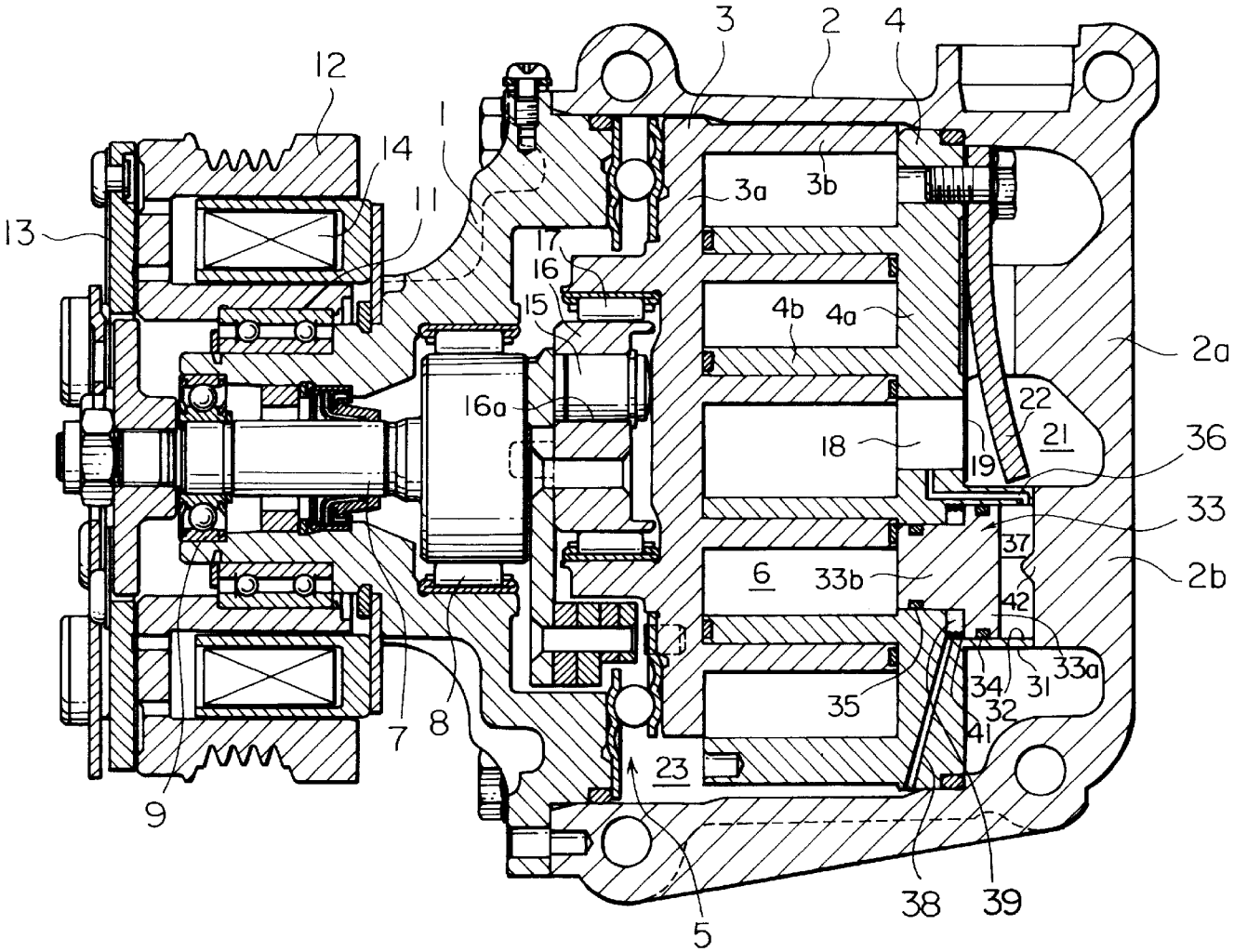
FIG. 1 is a sectional view of a scroll compressor according to a first embodiment of the invention.
Figure 2:
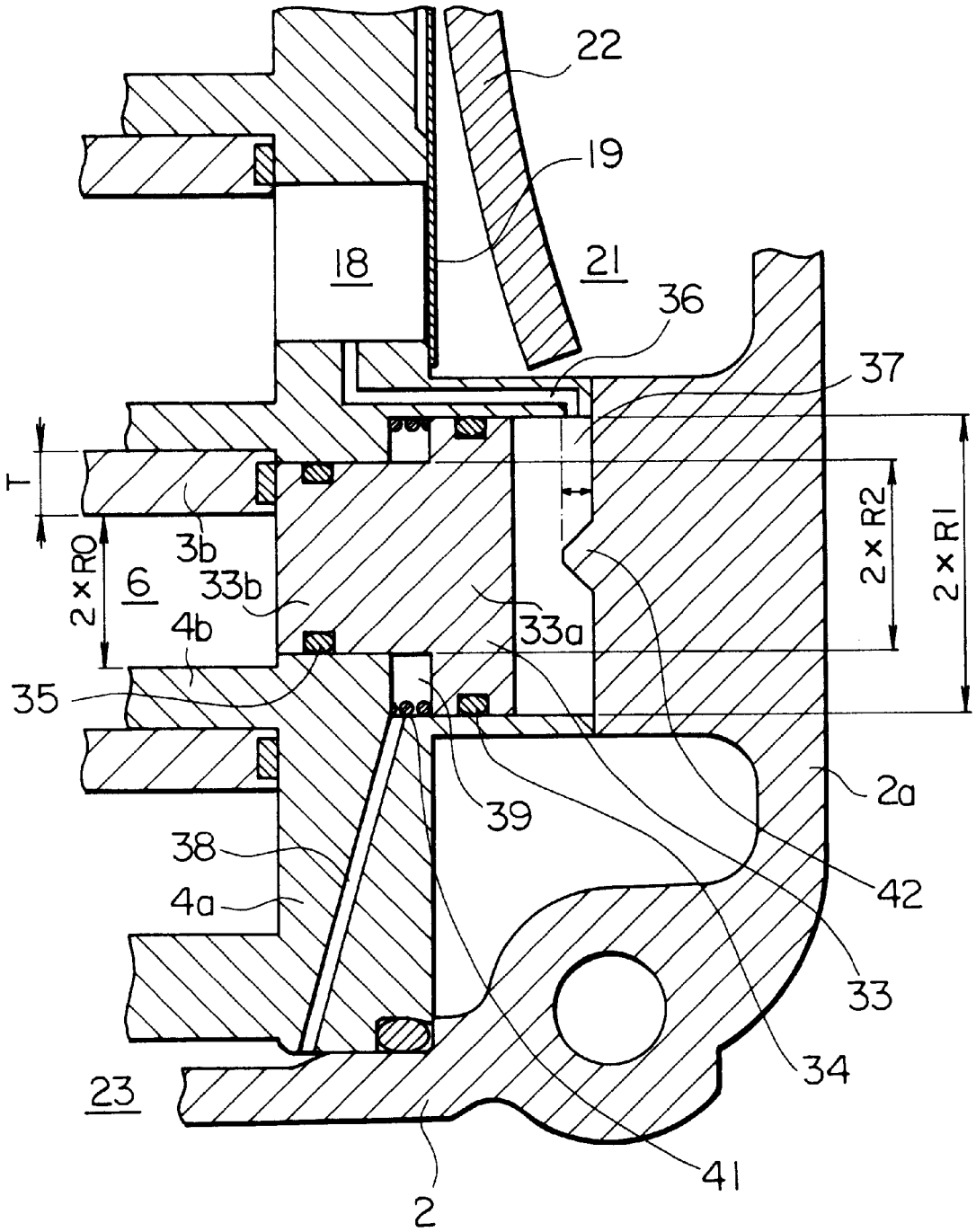
FIG. 2 is an enlarged view of a principal portion of the scroll compressor of FIG. 1, showing a normal operation of the scroll compressor.
Figure 3:
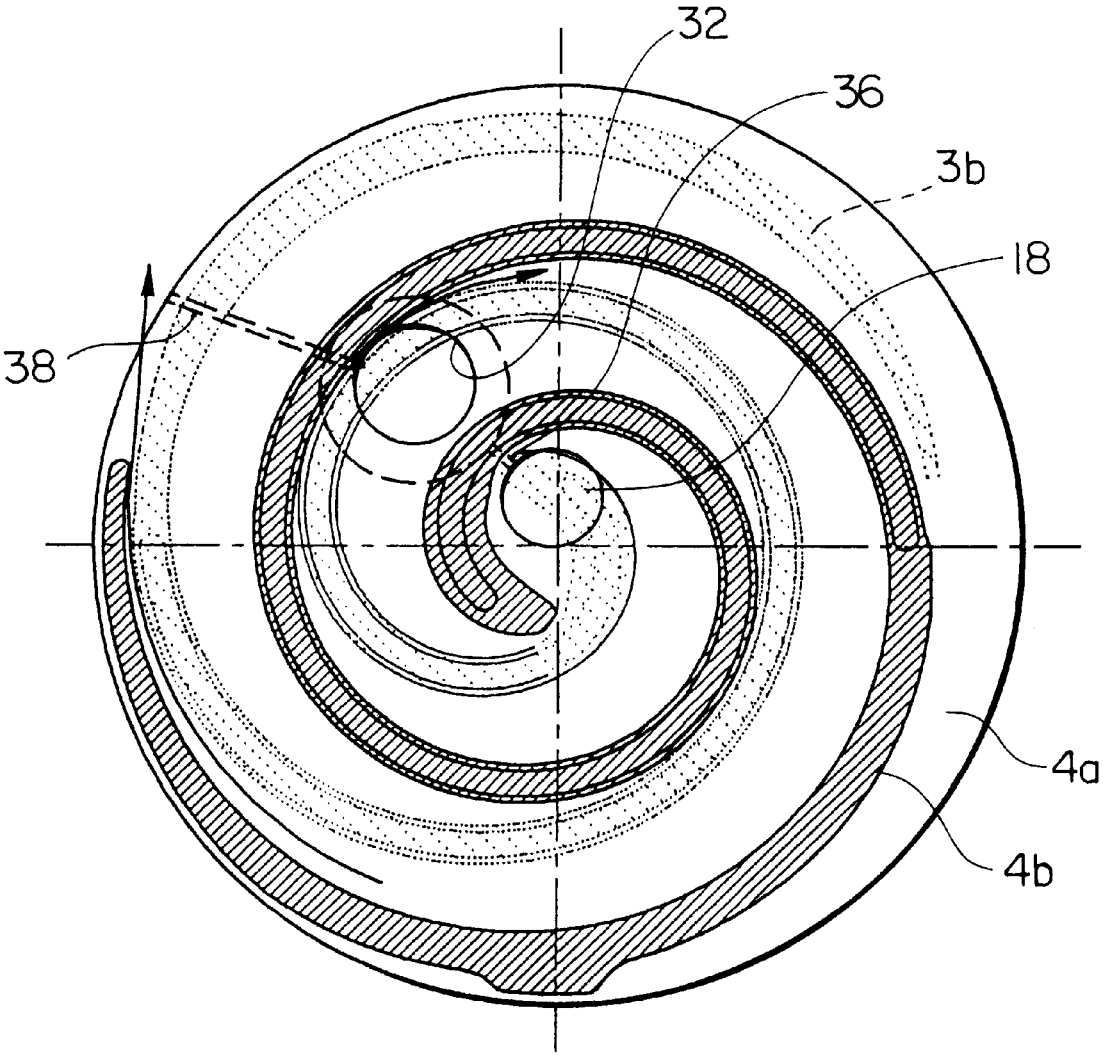
FIG. 3 is a transversally sectional view of the scroll compressor of FIG. 1, showing the normal operation.
Figure 4:
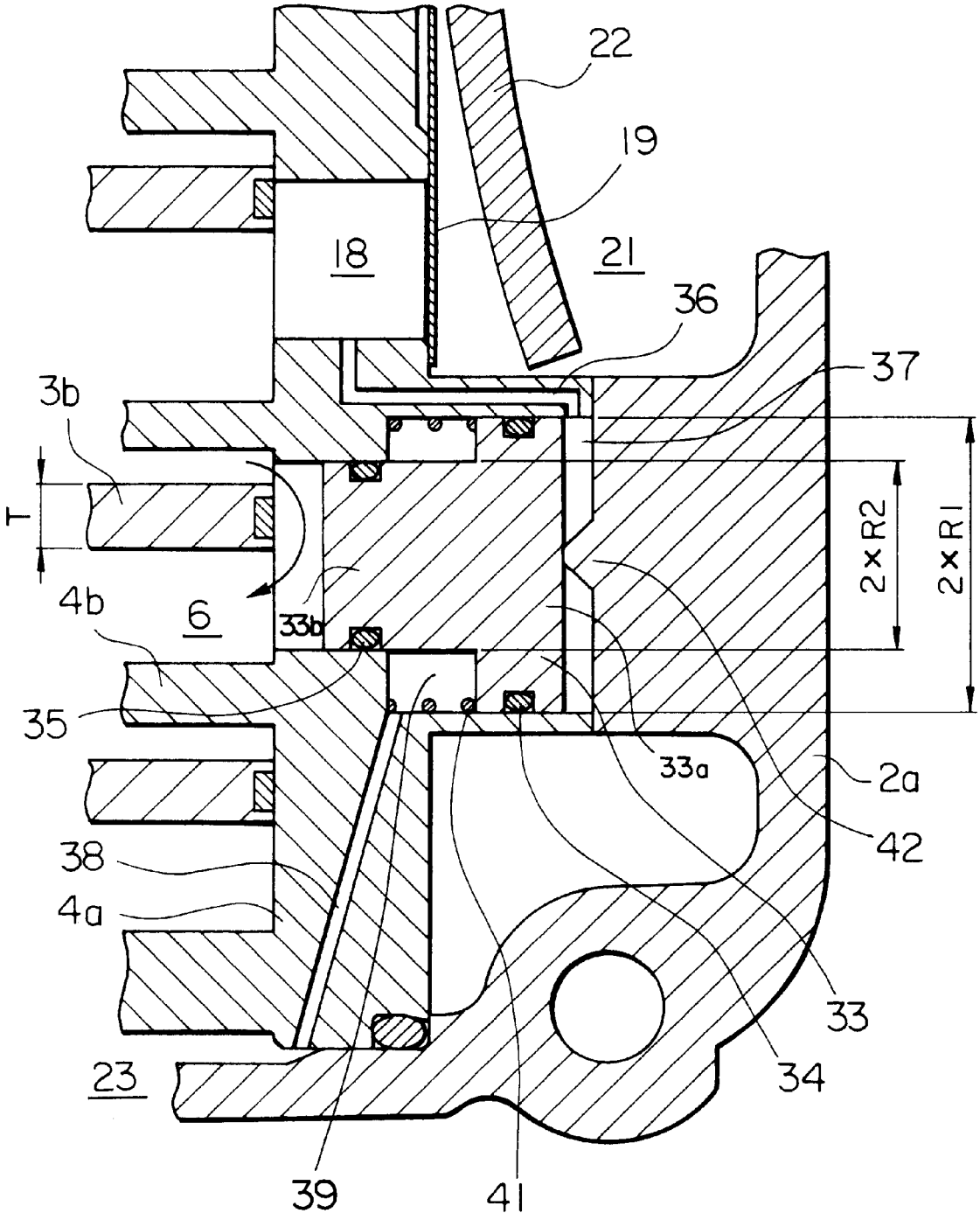
FIG. 4 is an enlarged view of a principal portion of the scroll compressor of FIG. 1 at a starting time of operation.
Figure 5:
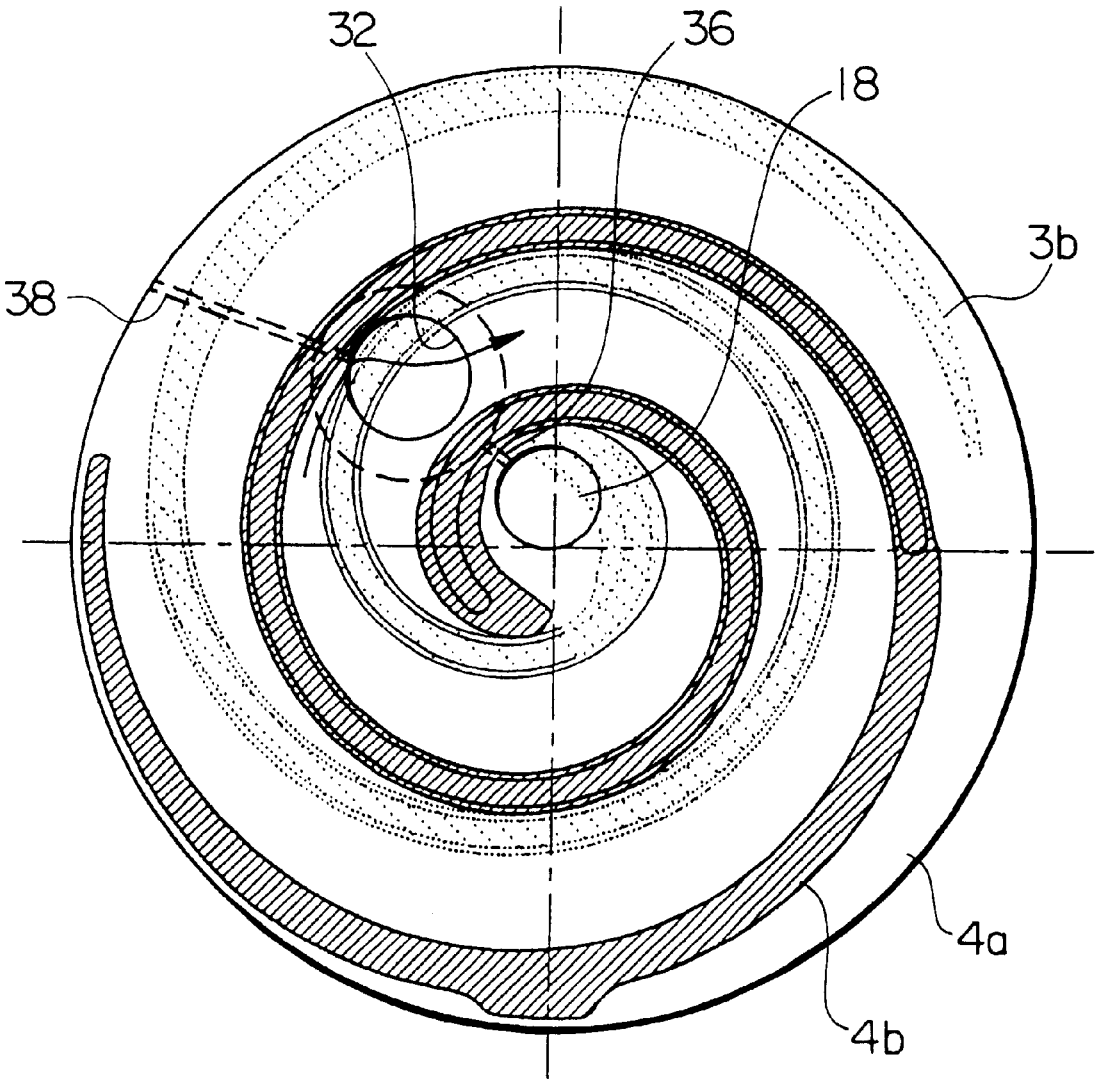
FIG. 5 is a transversally sectional view of the scroll compressor of FIG. 1 at the starting time of operation.

Referring to FIG. 1, description will be made as regards a scroll compressor according to a first embodiment of the present invention.

The scroll compressor is the compressor of the type mounted in and used for an air conditioner for an automobile. The scroll compressor has a front housing 1 and a rear housing 2 coupled with the front housing 1. The rear housing 2 includes therein a movable scroll member 3 and a fixed scroll member 4. The movable scroll member 3 has an involute portion 3*b* integrally formed on one surface of an end plate 3*a*. Similarly, the fixed scroll member 4 has an involute portion 4*b* integrally formed on one surface of an end plate 4*a*. Each of the end plates 3*a* and 4*a* extends in a radial direction. Each of the involute portions 4*b* protrudes from each of the end plates 3*a* and 4*a* in an axial direction.

The fixed scroll member 4 is fixed at its end plate 4*a* to the rear housing 2. On the other hand, the movable scroll member 3 is received at its end plate 3*a* by the front housing 1 through an anti-rotation mechanism 5. The involute portion 3*b* of the movable scroll member 3 is engaged with the involute portion 4*b* of the fixed scroll member 4 so that a plurality of compression spaces (that is, compressive operational chambers) 6 for the refrigerant gas are formed between the two involute portions 3*b* and 4*b*. The anti-rotation mechanism 5 serves to prevent a rotation of the movable scroll member 3 but, on the other hand, to permit an orbiting motion thereof along an orbital, circular passage.

In the front housing 1 is disposed a main shaft 7 one end of which is exposed to an outside of the front housing 1. The main shaft 7 is rotatably supported to the front housing 1 by radial bearings 8, 9. On the outer circumferential surface of the front housing 1, a rotor 12 is rotatably mounted through a radial bearing 11. The rotor 12 is coupled with an engine of the automobile through a belt means (not shown). An armature 13 which is opposed, with a very small gap, to an end of an axis of the rotor 12 is axially and resiliently movably supported at an end of the main shaft 7. The front housing 1 is provided with an electromagnetic solenoid 14. Thus, the rotor 12, the armature 13 and the electromagnetic solenoid 14 constitute in combination an electromagnetic clutch known in the art. When an electric current is applied to the electromagnetic solenoid 14, the armature 13 is attracted to the shaft end of the rotor into a unitary structure. A driving power of the automobile engine is transmitted to the main shaft 7 by way of the rotor 12 and the armature 13 to thereby rotate the main shaft 7 at the driving time of the engine.

An eccentric pin 15 is provided to the other end of the main shaft 7. An eccentric bush 16 is rotatably supported, through a radial bearing 17, to an opposite surface of the end plate 3*a* of the movable scroll member 3. The eccentric pin 15 is inserted into an eccentric hole 16*a* of the eccentric bush 16.

When the main shaft 7 is rotated, the eccentric pin 15 is turned about an axis of the main shaft 7 and forces the movable scroll member 3 into an orbital movement along an orbital or circular passage through the eccentric bush 16. Accordingly, the compression spaces 6 are moved towards a central portion along the walls of the involute portions 3*b* and 4*b* with its volume decreasing to provide a compression of the refrigerant gas. The compressed refrigerant gas moves from the central compression space having a maximum pressure to a discharge port 18, which is formed on the end plate 4*a* of the fixed scroll member 4 in accordance with the central portion, and serves to open the discharge valve 19, and then the compressed refrigerant gas is discharged to the discharge chamber 21 formed between the end plate 4*a* and the rear housing 2. In the figure of the drawing, a reference numeral 22 represents a retainer for serving to hold the discharge valve 19.

The refrigerant gas in the discharge chamber is then discharged out of the apparatus through a discharge port portion (not shown) formed in the rear housing 2. On the other hand, a refrigerant gas introduced from a suction port (not shown)formed in the rear housing 2 into the suction chamber 23 is forcibly received by the compression space 6 at the outer circumferential portion of the involute portions 3*b* and 4*b*.

In the scroll compressor described above, a projection portion 2*b* projecting forwardly is proved on an inner surface of a rear plate 2*a* of the rear housing 2. On the other hand, a projecting portion 31 is formed on the end plate 4*b* of the fixed scroll member 4 such that the projecting portion 31 projects rearwardly and contacts the projection portion 2*b* of the rear housing 2. In compliance with the projecting portion 31 and, moreover, in compliance with the gap of the involute portion 4*b* of the fixed scroll member 4, a two-step shaped hole 32 serving as a cylinder hole is formed extending axially through the end plate 4*b*. In other words, the fixed scroll member 4 is formed with a hole defining surface for defining the two-step shaped hole 32. The two-step shaped hole 32 has a relatively small diameter at its one end and is opened at one surface portion of the end plate 4*b* so that it can extend through the compression space 6. However, the other end of the two-step shaped hole 32 has a relatively large diameter and is contacted with the projection portion 2*b* of the housing 2 to be closed.

A valve member or a piston valve 33 is axially slidably inserted into the two-step shaped hole 32 such that it is slidable between a first position which contacts an upper end surface of the involute portion 3*b* of the movable scroll member 3 and a second position which is spaced from the first position. When placed at the first position, the piston valve 33 inhibits communication between adjacent ones of the compression spaces 6 through the two-step shaped hole 32. When placed at the second position, the piston valve 33 allows the communication between the adjacent compression spaces 6 through the two-step shaped hole 32.

The piston valve 33 has a relatively small diameter at its one end portion and a relatively large diameter at the other end portion. The piston valve 33 is provided, at its outer circumferential surface, with sealing members 34, 35 so that a gap between the outer circumferential surface of the piston valve 33 and an inner surface of the two-step shaped hole 32 is sealed by the sealing members 34, 35. Thus, sealed spaces are formed at both axial ends of the large diameter portion 33*a* of the piston valve 33. One of the sealed spaces, that is, a first sealed space is connected to the discharge port 18 through a discharge pressure inlet 36 and, accordingly, will be referred to as a discharge pressure space 37. Thus, the discharge pressure in a particular or central one of the compression spaces 6 is applied to the piston valve 33 to urge the piston valve 33 towards the first position when the scroll compressor is driven. A combination of the discharge port 18, the discharge pressure inlet 36, and the discharge pressure space 37 will be referred to as a first urging arrangement.

The other sealed space, that is, a second sealed space is connected to the suction chamber 23 through a suction pressure inlet 38 and, accordingly, referred to as a suction pressure space 39. In the suction pressure space 39, a compressed coil spring 41, as a biasing means, us provided for resiliently biasing the piston valve 33 toward the projection portion 2*b*. A combination of the suction pressure inlet 38 and the suction pressure space 39 will be referred to as a suction-pressure applying arrangement which is for applying the suction pressure to urge the piston valve 33 towards the second position. A combination of the suction-pressure applying arrangement and the compressed coil spring 41 will be referred to as a second urging arrangement.

The displacement of the piston valve 33 toward the projection portion 2*b* is limited by a valve stopper 42 which is provided at the projection portion 2*b*. It is preferable that the valve stopper 42 is protruded from the projection portion 2*b* to have a circular truncated cone shape known in the art. Since the displacement of the piston valve 33 is limited as described above, it is possible to provide the discharge pressure inlet 36 and the suction pressure inlet 38 at the positions which are not closed or covered in any way by the piston valve.

Referring to FIGS. 2 to 5 in addition, the description will be directed to an operation of the scroll compressor of FIG. 1.

A biasing force to the piston valve 33 in the direction of an increasing axial dimension of the clearance between the axial end surface (that is, the upper end surface) of the involute portion 3*b* of the movable scroll compressor 3 and an end of the small diameter portion 33*b* of the piston valve 33 is a sum of: (a) a pressure of the suction chamber 23 which is added to the large diameter portion 33*a* of the piston valve 33 in an opposed relation with the stepped portion of the two-step shaped hole 32 of the fixed scroll member 4, (b) a pressure of the compression space 6 which is added to the small diameter portion 33*b* of the piston valve 33 in an opposed relation with the end surface of the involute portion 3*b* of the movable scroll member 3, and (c) a resilient force of the compressed coil spring 41.

On the other hand, a biasing force which biases the piston valve 33 in the direction of clearance decreasing direction between the upper end of the involute portion 3*b* of the movable scroll member 3 and the end of the small diameter portion 33*b* of the piston valve 33 is the pressure at the position of the space located in front of, and adjacent to, the discharge valve 19 which acts upon the stepped portion of the two-step shaped hole 32 of the fixed scroll member 4 of the large diameter portion 33*a* of the piston valve 33 and also acts upon the other side of the stepped portion of the two-step shaped hole 32.

The compressed coil spring 41 is provided with characteristics which satisfy the formula (1) and formula (2) set forth below.

$$(Ps0\times A1)+(Ps0\times A2)+(K\times a)>(Pd0\times Ad) \quad (1)$$

$$(Ps1\times A1)+(Ps2\times A2)+K\times(a+\Delta a)<(Pd\times Ad) \quad (2)$$

wherein, R1 represents a radius of a large diameter portion 33*a* of the piston valve 33, R2 represents a radium of a small diameter portion 33*b* of the piston valve 33, A1 represents a pressure receiving area of a flange of the large diameter portion 33*a* of the piston valve 33, A2 represents a pressure receiving area of the small diameter portion 33*b* of the piston valve 33, Ad represents a pressure receiving area of the large diameter portion 33*a* of the piston valve 33, K represents a spring modulus of the compressed coil spring 41, "a" represents an initial deflection of the compression coil spring before operation, Δa represents a stroke of the piston valve 33, (a+Δa) represents a deflection amount of the compressed coil spring 41 at the normal operation, Ps0 represents a suction pressure of starting time of operation, Ps1 represents a suction pressure in a normal operation, Ps2 represents a pressure of the compression space 6 added to the small diameter portion 33*b* of the piston valve 33 in the normal operation, Pd0 represents a discharge pressure at the starting time of operation, and Pd represents a discharge pressure in the normal operation.

Here, it is understood that A1, A2 and Ad are obtained by the following formulas:

$$A1=\pi\times(R1^2-R2^2)$$

$$A2=\pi\times(R2^2)$$

$$Ad=\pi\times(R1^2)$$

As will be understood from the foregoing description, a clearance is formed, at the starting time of compressor, between the upper end surface of the involute portion 3*b* of the movable scroll member 3 and the end surface of the small diameter portion of the piston valve 33. The refrigerant gas is flown into the compression space of a lower pressure side through the clearance so that compression becomes impossible there. On the other hand, the compression becomes possible only the place of the involute portion which is near the center. This, therefore, provides a reduction of a shock at the starting time of operation. After that, as the value of Pd is growing, the clearance between the upper end surface of the involute portion 3*b* of the movable scroll member 3 and the end surface of the small diameter portion 33*b* of the piston valve 33 becomes smaller. In the final step, the clearance described above is reduced to zero at the normal operation shown in FIGS. 2 and 3. And the refrigerant gas received and held by the outermost circumference of the involute portion 3*b* is moved toward the discharge port and then proceeded to a normal compression operation.

If R0 which represents a radius of an orbiting motion of the movable scroll member 3, and T which presents a thickness of the involute portion of the movable scroll member 3 are determined so as to satisfy formula (3) set forth below, the piston valve 33 is placed in the condition that it is abutted against the movable scroll member 3 and, therefore, it is possible to make no generation of a space relative to the involute portion 3*b* of the movable scroll member at the time of normal operation.

$$(2\times R0)<(2\times R2)<(2\times R0+T) \quad (3)$$

Here, each portion of the two steps of the piston valve 33 is sealed at its position which is contacted with the two-step shaped hole 32 of the fixed scroll member 4 and, therefore, the refrigerant gas in the compression procedure is prevented from being leaked and thus degradation of properties can be prevented.

Figure 6:
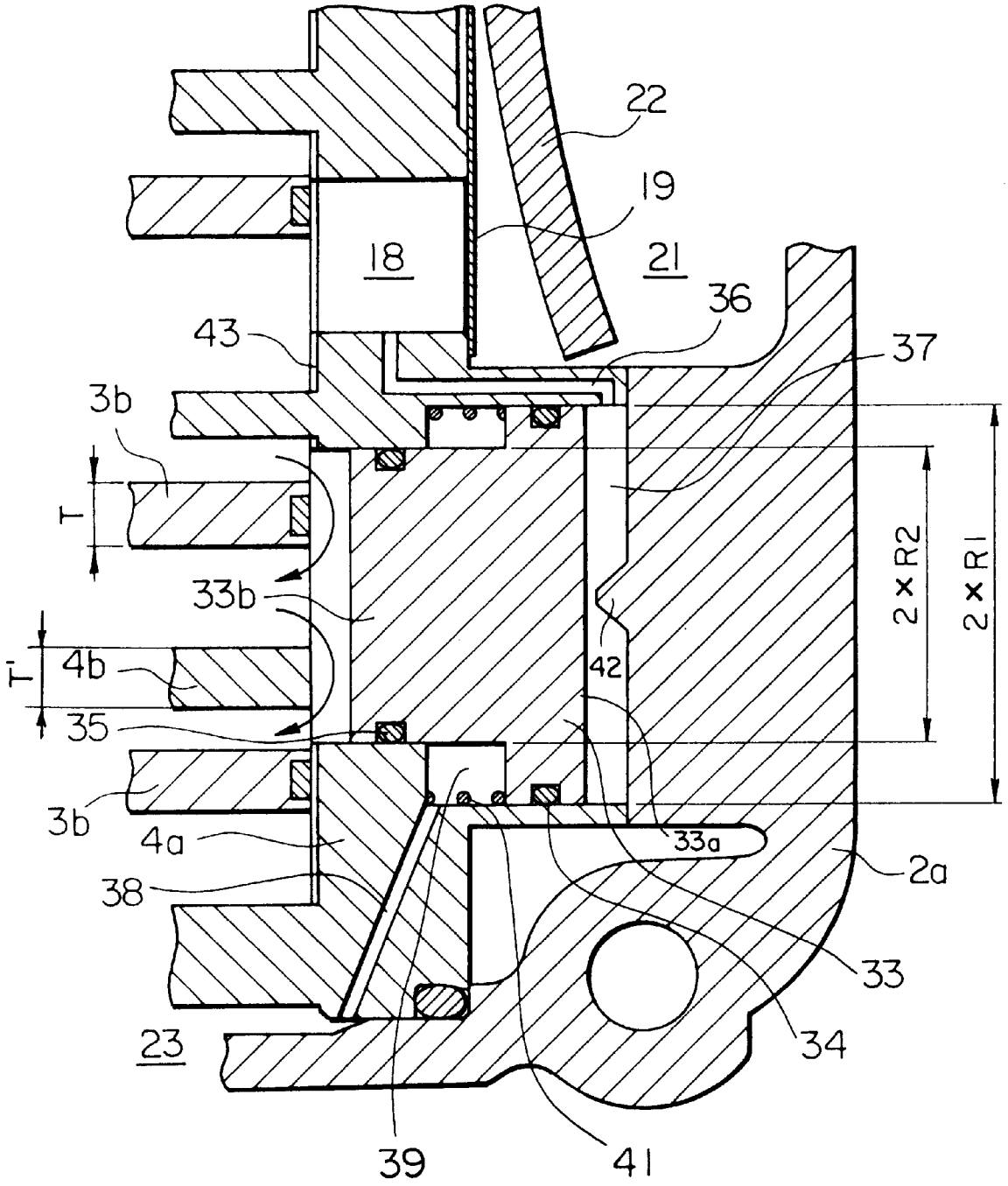
FIG. 6 is a sectional view of a scroll compressor according to a second embodiment of the invention.
Figure 7:
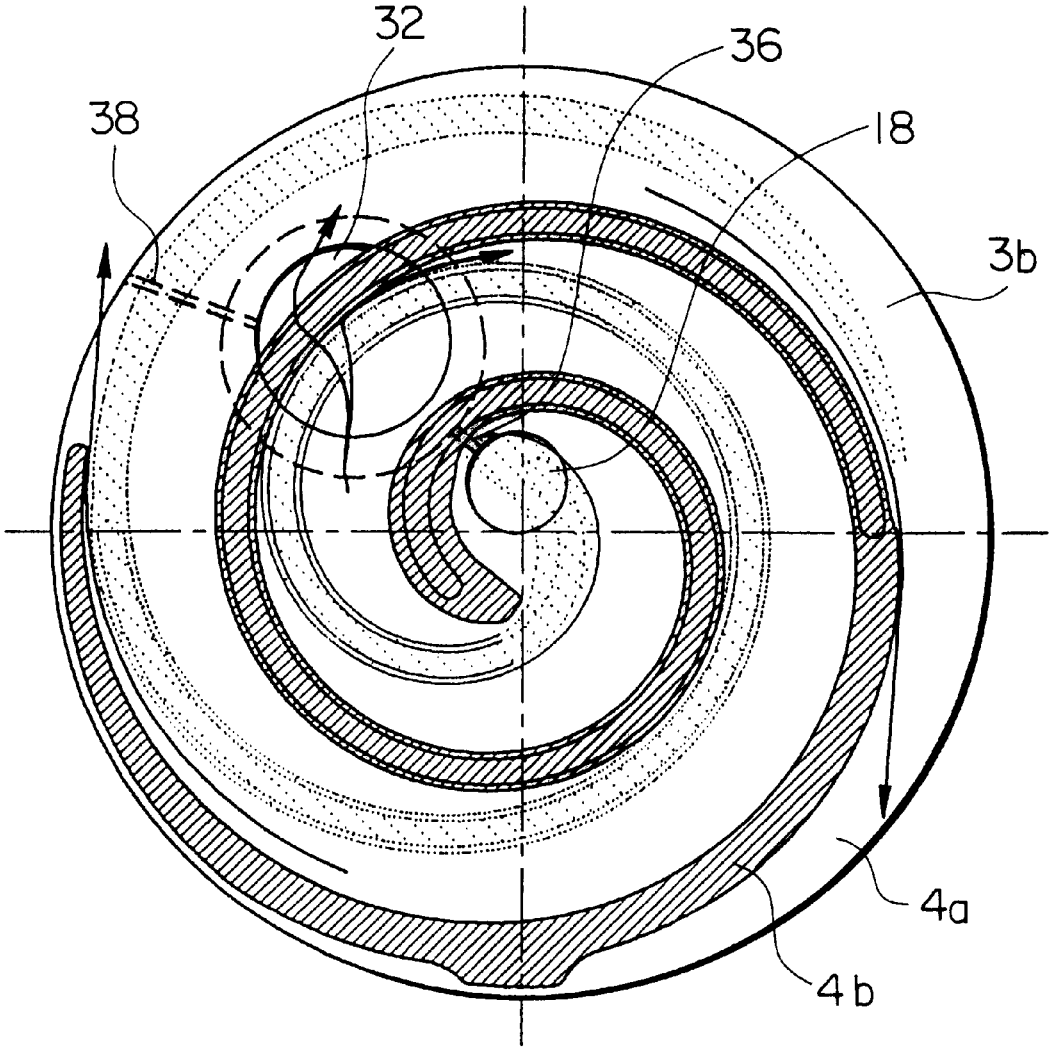
FIG. 7 is a transversally sectional view of the scroll compressor of FIG. 7 at the normal operation.
Figure 8:
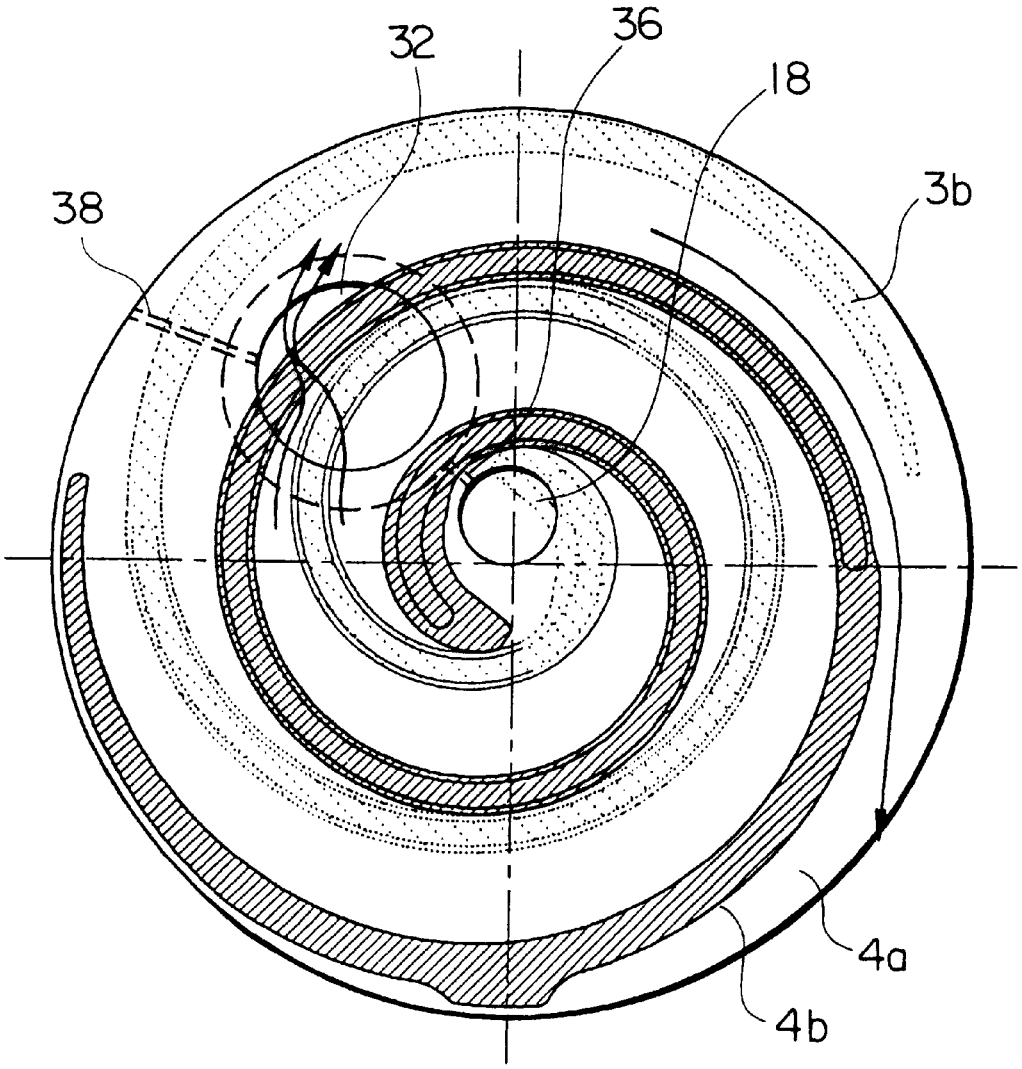
FIG. 8 is a transversally sectional view of the scroll compressor of FIG. 6 at the starting time of operation.

Turning to FIGS. 6 to 8, the description will be made as regards a scroll compressor according to a second embodiment of the invention. Similar parts are designated by like reference numerals.

In the scroll compressor, the location of the piston valve 33 is changed from that of the previous embodiment. Namely, in the scroll compressor of FIGS. 1 through 5, the piston valve 33 is located at the position which is correspondent to the gap of the involute portion 4*b* of the fixed scroll member 4, but in the second embodiment shown in FIGS. 6 to 8 the piston valve 33 is disposed at the position correspondent to the wall of the involute portion 4*b* of the fixed scroll member 4.

More specifically, the lower portion of the involute portion 4*b* of the fixed scroll member 4 is hollowed to provide a two-step shaped hole 32 to satisfy the following formula (4) and the piston valve 33 is slidably mounted on the two step shaped hole 32.

$$(2\times R0+T)<(2\times R2)<(4\times R0+T) \quad (4)$$

By the structure described above, the condition of FIGS. 6 and 7 can be established at the starting time of operation and, therefore, a shock is reduced at the starting time of operation. In the normal operation, the end of the small diameter portion 33*b* of the piston valve 33 is contacted with the involute portion 4*b* and, accordingly, a normal and regular compression operation can be attained. In the figures of the drawing, reference numeral 43 represents a bottom plate which is extended along a bottom of the gap of the involute portion 4*b* of the fixed scroll member 4.

Figure 9:
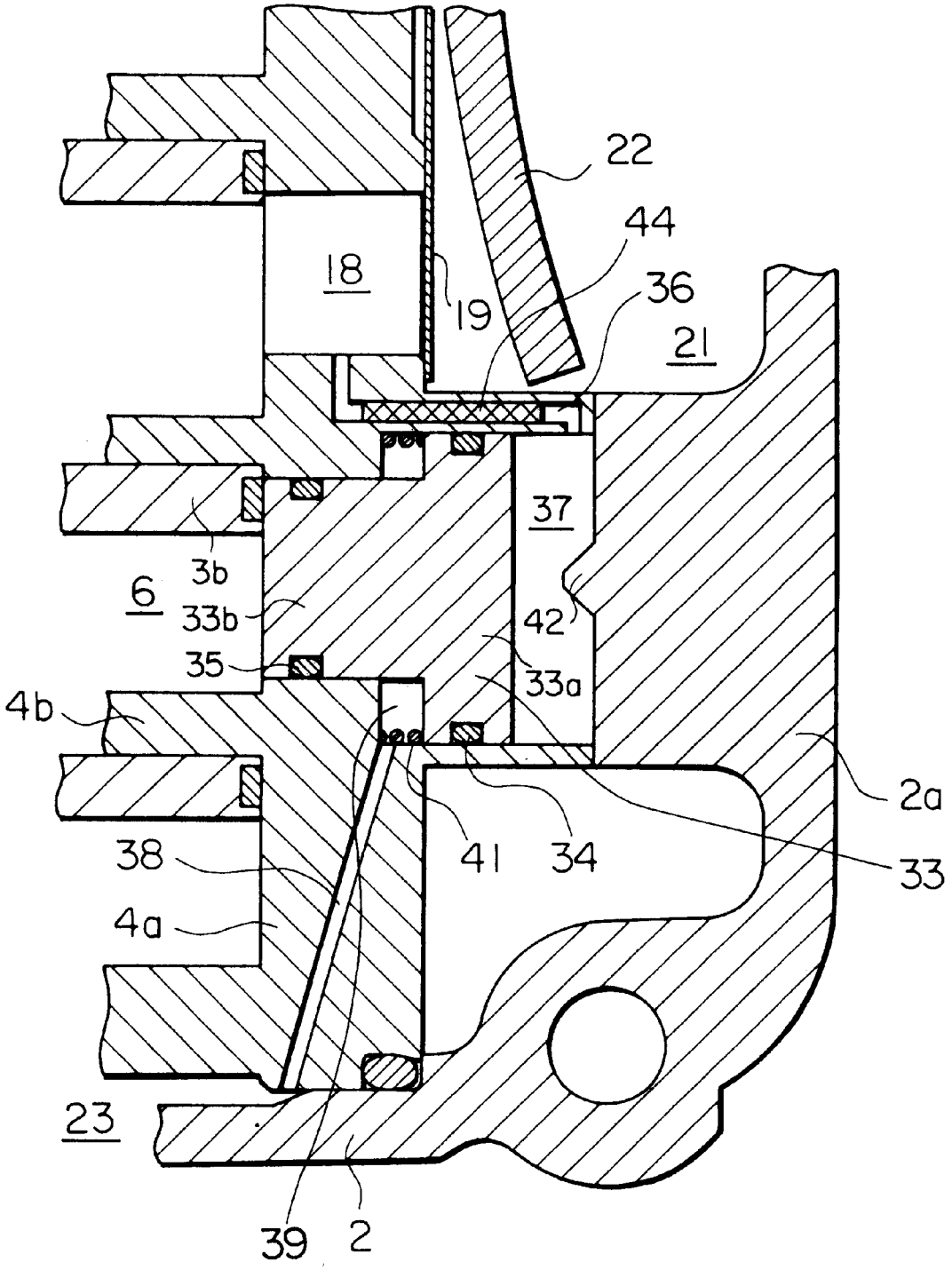
FIG. 9 is a sectional view of a scroll compressor according to a third embodiment of the invention.

Turning to FIG. 9, the description will be made as regards a scroll compressor according to a third embodiment of the invention. Similar parts are designated by like reference numerals.

In the scroll compressor, the discharge pressure inlet 36 is provided with an orifice tube 44 inserted into the discharge pressure inlet 36 so that an orifice is disposed on the way of the discharge pressure inlet 36. The orifice on the way of the discharge pressure inlet 36 will permit a gentle increase of a biasing force for biasing the piston valve 3 and, at the same time, it is unlikely that any influence or harmful effect by pressure variation such as a discharge pulsation is received.

Figure 10:
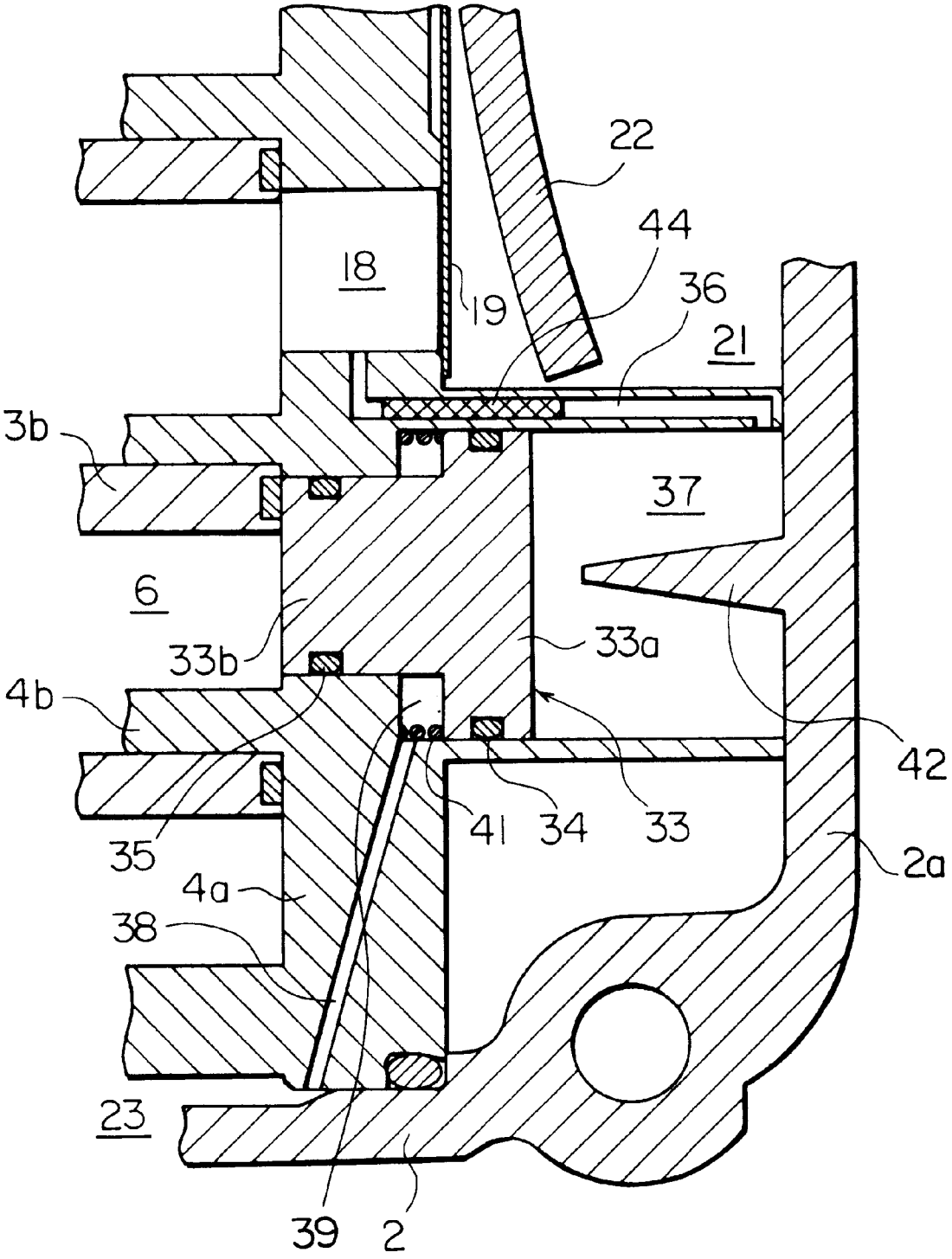
FIG. 10 is a sectional view of a scroll compressor according a fourth embodiment of the invention.

Turning to FIG. 10, the description will be made as regards a scroll compressor according to a fourth embodiment of the invention. Similar parts are designated by like reference numerals.

In the scroll compressor, there is provided a discharge pressure space 37 which is designed to have a relatively large volume. This structure permits a still gentler increase of the biasing force for biasing the piston valve 33 and, therefore, the discharge pressure space 37 serves effectively as a "buffer" chamber. Each of the scroll compressors described above permits substantial reduction of the load variation at the starting time of operation without involvement of problems such as a pressure loss and undesired large sizing.

While the present invention has thus far been described in connection with a few embodiments thereof, it will readily be possible for those skilled in the art to put this invention into practice in various other manners. For example, other types of biasing device can be selectively used as the compressed coil spring. The piston valve may be movable in the radial direction.

What is claimed is:

1. A scroll compressor comprising a fixed scroll member and a movable scroll member which define a plurality of compression spaces therebetween in cooperation with each other, said compression spaces being movable with volumes reduced by movement of said movable scroll member, said scroll compressor further comprising:

a hole defining surface formed to said fixed scroll member for defining a hole communicable with adjacent ones of said compression spaces, said adjacent ones being different from each other in pressure when said scroll compressor is driven; and a valve member disposed in said hole for controlling communication between said adjacent ones through said hole.

2. A scroll compressor as claimed in claim 1, wherein said fixed scroll member comprises:

an end plate extending in a radial direction; and an involute portion protruded from said end plate of the fixed scroll member in an axial direction;

said movable scroll member comprising:

an end plate extending in said radial direction; and an involute portion protruded from said end plate of the movable scroll member in said axial direction and engaged with said involute portion of the fixed scroll member to define said compression spaces therebetween, said hole being formed to said end plate of the fixed scroll member.

3. A scroll compressor as claimed in claim 2, wherein said hole extends in said axial direction, said valve member being slidable along said hole defining surface in said axial direction between a first position at which said valve member inhibits said communication and a second position at which said valve member allows said communication.

4. A scroll compressor as claimed in claim 3, further comprising:

first urging means coupled to said valve member for urging said valve member towards said first position; and second urging means coupled to said valve member for urging said valve member towards said second position.

5. A scroll compressor as claimed in claim 4, wherein said first urging means is connected between a particular one of said compression spaces and said valve member for applying discharge pressure to said valve member to urge said valve member towards said first position, said particular one having said discharge pressure when said scroll compressor is driven.

6. A scroll compressor as claimed in claim 5, wherein said first urging means comprises:

a discharge port formed in said end plate of the fixed scroll member to be connected to said particular one of the compression spaces;

a discharge pressure space adjacent to said valve member; and a discharge pressure inlet extending between said discharge port and said discharge pressure space.

7. A scroll compressor as claimed in claim 6, wherein said discharge pressure inlet has an orifice tube inserted therein.

8. A scroll compressor as claimed in claim 4, wherein said second urging means comprises:

a compressed spring interposed between said end plate of the fixed scroll member and said valve member to urge said valve member towards said second position; and suction-pressure applying means connected to said valve member for applying suction pressure to said valve member to urge said valve member towards said second position.

9. A scroll compressor as claimed in claim 8, wherein said suction-pressure applying means comprises:

a suction pressure space formed between said end plate of the fixed scroll member and said valve member; and a suction pressure inlet extending between said suction pressure space and a suction chamber of said scroll compressor.

10. A scroll compressor as claimed in claim 2, wherein said valve member is disposed in said hole such that said valve member is movable between a first position contacted with an upper surface of an involute portion of said movable scroll member and a second position spaced from said first position, and said valve member has a small diameter portion such that in said first position of said valve member the relation among a radius (R2) of the end surface of said small diameter portion, a radius (R0) of an orbiting motion of said movable scroll member, and a thickness (T) of said movable involute portion is set to satisfy the following:

$$(2\times R0)<(2\times R2)<(4\times R0+T),$$

said hole being positioned away from said fixed involute portion.

11. A scroll compressor as claimed in claim 2, wherein said valve member is disposed in said hole such that said valve member is movable between a first position contacted with an upper surface of an involute portion of said movable scroll member and a second position spaced from said first position, and said valve member has a small diameter portion such that in said first position of said valve member the relation among a radius (R2) of the end surface of said small diameter portion, a radius (R0) of an orbiting motion of said movable scroll member, and a thickness (T') of said fixed involute portion is set to satisfy the following:

$$(2\times R0+T')<(2\times R2)<(4\times R0+T'),$$

at most one position of said fixed involute portion facing said hole.

12. A scroll compressor comprising:

a fixed scroll member having an end plate;

a movable scroll member eccentrically spaced from said fixed scroll member and having an end plate;

a compression space formed between said fixed scroll member and said movable scroll member, said compression space being movable with its volume reduced by an orbiting movement of said movable scroll member;

a cylinder channel provided on said end plate of the fixed scroll member and capable of being connected with said compression space; and a piston valve disposed in said cylinder channel such that said piston valve is movable between a first position contacted with an upper surface of an involute portion of said movable scroll member and a second position spaced from said first position, a fluid in the compression space being permitted to flow into a low pressure space between said movable scroll member and said fixed scroll member through said cylinder channel when said piston valve is position in said second position.

13. A scroll compressor as claimed in claim 12, wherein a plurality of compression spaces are formed so that said piston valve is driven by utilization of the difference of pressure between said compression spaces.

14. A scroll compressor as claimed in claim 12, wherein a first compression space of a maximum pressure and a second compression space of a lower pressure are formed and a bias means is provided for biasing said piston valve into said first position by a pressure difference between the fluid-discharge pressure of said first compression space and the pressure of said second compression space and biasing said piston valve against said pressure difference.

15. A scroll compressor comprising:

a fixed scroll member having an end plate;

a movable scroll member eccentrically spaced from said fixed scroll member and having an end plate;

a compression space formed between said fixed scroll member and said movable scroll member, said compression space being movable with its volume reduced by an orbiting movement of said movable scroll member;

at least a single two-step shaped hole provided on said end plate of the fixed scroll member such that said two-step shaped hole is opened at one side thereof to said compression space, with a sectional area of the opened portion being smaller than a sectional area of the other portion;

a two-step shaped piston valve slidably contacted with each step of said two-step shaped hole;

a first sealed space formed between a large diameter portion and a step portion of said two-step shaped hole, a biasing means, disposed in said first sealed space and contacted with said large diameter portion of the piston valve and said step portion of the two-step shaped hole of the fixed scroll member, for biasing said piston valve in the clearance-increasing direction between an upper end surface of an involute portion of said movable scroll member and an end surface of a small diameter portion of said piston valve;

a suction pressure inlet, disposed on said end plate of the fixed scroll member, for connecting said first sealed space with said suction chamber;

a second sealed space formed in a confronting relation with said first sealed space with said large diameter portion of the piston valve being disposed therebetween; and a discharge pressure inlet connecting said second sealed space with a discharge port of said fixed scroll member.

* * * * *